US007639204B2

(12) United States Patent
Chau

(10) Patent No.: US 7,639,204 B2
(45) Date of Patent: Dec. 29, 2009

(54) LOW VISIBILITY, FIXED-TUNE, WIDE BAND AND FIELD-DIVERSE ANTENNA WITH DUAL POLARIZATION

(75) Inventor: Tam Hung Chau, Berkeley, IL (US)

(73) Assignee: Antenex, Inc., Glendale Heights, IL (US)

( * ) Notice: Subject to any disclaimer, the term of this patent is extended or adjusted under 35 U.S.C. 154(b) by 534 days.

(21) Appl. No.: 11/434,101

(22) Filed: May 15, 2006

(65) Prior Publication Data

US 2007/0262914 A1 Nov. 15, 2007

(51) Int. Cl.
*H01Q 1/00* (2006.01)
*H01Q 1/36* (2006.01)

(52) U.S. Cl. ..... 343/905; 343/895

(58) Field of Classification Search ..... 343/702, 343/872, 895, 905, 767, 770
See application file for complete search history.

(56) References Cited

U.S. PATENT DOCUMENTS

| | | | | |
|---|---|---|---|---|
| D157,090 | S | 1/1950 | Schmidt | D14/234 |
| D356,314 | S | 3/1995 | Rich et al. | D14/236 |
| D357,683 | S | 4/1995 | Cline et al. | D14/234 |
| D418,840 | S | 1/2000 | Cota et al. | D14/230 |
| 6,023,245 | A | 2/2000 | Gomez et al. | 343/725 |
| D429,720 | S | 8/2000 | Strand | D14/230 |
| D443,263 | S | 6/2001 | Strand et al. | D14/230 |
| D461,796 | S | 8/2002 | Boyer | D14/230 |
| D465,480 | S | 11/2002 | Boyer | D14/230 |
| D470,131 | S | 2/2003 | Noro et al. | D14/230 |
| D470,481 | S | 2/2003 | Ikeda | D14/230 |
| D472,892 | S | 4/2003 | Tourres | D14/230 |
| D480,712 | S | 10/2003 | Noro | D14/230 |
| D481,028 | S | 10/2003 | Wu | D14/230 |
| D482,350 | S | 11/2003 | Noro et al. | D14/230 |
| D489,712 | S | 5/2004 | Nagatomi | D14/230 |
| D491,926 | S | 6/2004 | Tai et al. | D14/230 |
| D493,447 | S | 7/2004 | Noro et al. | D14/230 |
| 6,762,727 | B2 | 7/2004 | Rochford et al. | 343/713 |
| 6,806,767 | B2 * | 10/2004 | Dow | 330/51 |
| 7,209,096 | B2 * | 4/2007 | Chau | 343/895 |
| 2004/0183734 | A1 | 9/2004 | Noro | 343/713 |

* cited by examiner

*Primary Examiner*—Shih-Chao Chen
(74) *Attorney, Agent, or Firm*—Harness, Dickey & Pierce, P.L.C.

(57) ABSTRACT

A low-visibility, fixed-tune, wideband, and field-diverse antenna provides cross-polarized fields enhancing signal communications but having helical antenna characteristics without severe circular polarization radiation thereby promoting a modern, futuristic, and disguised look for reliable communications. A generally flat, but helical, antenna is achieved in conjunction with a core substrate about which the antenna is wrapped, wound, or fixed. The core substrate, pitch or angle of the helix, length of the transmitting antenna, and copper traces thickness are chosen for a specific resonant frequency range. The length and width of the helix are chosen in order to dimension the helical antenna between its linear and circular polarization modes to thereby deliver field-diverse and cross-polarized transmission modes. In order to optimize the manufacturing process, holes may be created within the substrate. These holes are plated with conducting material so that conducting foil on opposite faces of the substrate may be electrically connected. The holes may be offset according to the pitch of the helix. Once the transmitting antenna has been fabricated upon the core substrate, the margin between the plated-through holes and the edge of the substrate may be separated by cutting, sawing, or stamping.

27 Claims, 9 Drawing Sheets

LOW VISIBILITY, FIXED-TUNE, WIDE BAND AND FIELD-DIVERSE ANTENNA WITH DUAL POLARIZATION

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND OF THE INVENTION

1. Field of the Invention

This invention relates to antennas and more particularly an antenna that uses cross-polarization with either a ground plane or no ground plane to provide enhanced telecommunications or the like.

2. Description of the Related Art

U.S. Pat. Nos. 5,977,931 and 6,292,156, both issued to Openlander and both entitled Low Visibility Radio Antenna With Dual Polarization with the former issued on Nov. 2, 1999 and the latter issued on Sep. 18, 2001 are both incorporated herein by this reference.

Prior attempts have been made in the art with respect to radio antennas and otherwise. Brief descriptions of some of such prior attempts are included in the background information set forth below. While the descriptions are believed to be accurate, no admission is made by them regarding their subject matter which is solely defined by the patent or reference involved.

All forms of radio or similar telecommunications require an antenna in order to transmit and receive radio waves and the like for communication. With increasing cellular and PCS communications and short-distance telecommunications, antennas are becoming more a part of the commonplace environment. Particularly with cellular telephones, the power supply for the antenna associated with the cellular phone is provided by a battery and is consequently limited in power and duration of the power supply. Due to these power and other limitations, it is important to provide an antenna that maximizes the efficiency of the available power, to transmit a clear signal as far as possible.

Stationary and other antennas, such as those mounted on cars and the like, are generally within easy reach of passersby or pedestrians. Such easy access makes such antennas often subject to vandalism or other unwanted attention. By making such antennas as inconspicuous as possible, undesired attention can be avoided and the useful life of the antenna can be extended. In order to achieve low visibility, the antenna must achieve a compact size through packaging and possibly disguised or non-traditional antenna shapes.

In the art, it is known that destructive interference occurs when reflected signals destructively interfere with transmitted signals. This is known as Raleigh fading and creates signal fading or dead spots that inhibit or diminish the desired communications for which cellular phones and the like are intended. In designing an antenna meant for daily or commonplace use in a cellular or similar environment, an advantageous antenna design avoiding Raleigh fading is not currently available and is something that would well serve the advancement of the telecommunications arts.

In order to decrease the apparent size of a monopole antenna, the antenna can be shortened by making the antenna in the shape of a spring, or coil, by winding it around a cylindrical core in the manner of a helix or otherwise. Such helical antennas are described in detail in Kraus, Antennas, Chapter 7, pp. 173-216 (McGraw Hill 1950) and in a number of U.S. patents. A practical example of a linearly polarized antenna may be found in the ARRL Antenna Handbook, "Short Continuously Loaded Vertical Antennas," pp. 6-18 to 6-19 (Gerald Hall ed., ARRL Press 1991).

Helical antennas may be made from wire or metal tape wrapped around a cylindrical core made of plastic or plastic-glass composite. In winding the antenna around the core, the length of the antenna and the pitch at which it is wound around the core are fashioned so that the resulting antenna is resonant at a desired frequency. A shortened antenna has the radiation resistance and consequent narrow bandwidth of a straight length wire of the same length. However, with the coiling of the wire about the core, an inductance is introduced that approximately cancels the series radiation capacitance of the equivalent short wire antenna.

The narrow bandwidth of such inductively shortened antennas can be used to good effect at frequencies below 30 MHz, where they enjoy frequent use. However, at higher frequencies, wider bandwidths are required and the narrow bandwidth of such antennas prevent them from being used at such higher frequencies. In order to compensate for the narrow bandwidth of the inductively-shortened antenna, common practice includes tuning means so that the frequency may be tuned by either expanding or contracting the length of the helix, or by adding resistances in series with the low radiation resistance of the antenna. This is shown in the patent to Simmons, Broadband [Helical] Antenna (U.S. Pat. No. 5,300,940 issued Apr. 5, 1994). By accommodating and compensating for the narrow bandwidth, an improvement is made in the apparent bandwidth in the VSWR (voltage standing wave ratio) of the antenna but at the expense of radiation efficiency. Of course, radiation efficiency is especially important for battery-powered transmitters and for those transmitters that are a significant distance (near the periphery of the transmitting range) from a cellular or other receiver.

Where tuning is impractical and/or where high efficiency is required, some additional bandwidth may be gained by making the helix larger in diameter thereby increasing the width to length ratio. However, as mentioned in the Kraus reference above, as the diameter of the helix is increased and as the pitch and length of the turns are adjusted to maintain the resonance of the antenna, the polarization of the resulting antenna changes from dispersive linear radiation to endfire circular radiation. This change of direction of radiation from broadside to endfire is generally impractical for mobile and portable applications. Such high directivity and such an unfavored angle of radiation impose certain inconveniences and limitations upon small transmitters and their antennas. However, there are some uses for an endfiring helical antenna such as those which are described in the patent to Wheeler entitled Antenna Systems (U.S. Pat. No. 2,495,399 issued January 1950).

Field diversity, that is the diversity in the polarization of the vertical and horizontal field components, is known to address and to help resolve Raleigh fading. K. Fujimoto and J. R. James, Mobile Antenna Systems Handbook, pp. 78-85 (Artech House 1994), A. Santamaria and F. J. Lopez-Hernandez, Wireless LAN Systems, p. 180 (Artech House 1994). The advantages arising from cross-polarized radio signals is also addressed in "Experimental Results with Mobile Antennas Having Cross-Polarization Components in Urban and Rural Areas," Kuboyama et al., IEEE Transactions on Vehicular Technology, Vol. 39, No. 2, May 1990, pp. 150-160. Field diversity, or cross-polarization, results when the horizontal and vertical field components of the radiated signal are radiated in phase. This is in opposition to circular polarization, which occurs when the horizontal and vertical field components are plus or minus 90 degrees out of phase and to the situations where only horizontal or vertical field components are present exclusively.

In order to obtain field diversity from an antenna, particularly a helical antenna, the helical antenna must be dimensioned between its linear and circular polarization modes in order to achieve field diversity. One such helical antenna is illustrated in FIG. 1 of the patent to Halstead, Structure with an Integrated Amplifier Responsive to Signals of Varied Polarization (U.S. Pat. No. 3,523,351 issued August 1970). As an alternative to the helical structure of the antenna, meander lines can be used as set forth in the patent to Drewett, Helical Radio Antenna (U.S. Pat. No. 4,160,979 issued Jul. 10, 1979). Radomes are also known in the art per the patent to Frese, Helical UHF Transmitting and Receiving Antenna (U.S. Pat. No. 5,146,235 issued Sep. 8, 1992).

Despite the established art and current developments thereof, the use of field diversity in a small antenna for cellular or similar use is not known in the art. Additionally, such antennas would provide significant advantage as radio telecommunications could then also take place in conjunction with a variety of different objects such as vending machines, as well as individuals with their cellular phones and other electronic data and information machines. To achieve greater utility, such an antenna should function well with or without ground planes and should provide impedance matching and compensating circuitry to maximize the bandwidth of the antenna.

SUMMARY OF THE INVENTION

In view of the foregoing disadvantages inherent in the known types of antennas now present in the prior art, the present invention provides a new antenna configuration for a low visibility antenna that is both fixed-tuned as well as being field-diverse while providing dual polarization wherein the same antenna can be used advantageously for wireless and other communication applications.

The general purpose of the present invention, described subsequently in greater detail below, is to provide a fixed-tuned antenna that is both field-diverse and that enjoys dual polarity, such antenna enjoying many of the advantages of antennas as known before as well as many novel features that result in a new antenna which is not anticipated, rendered obvious, suggested, taught, or even implied by any of the prior art antennas, either alone or in any combination thereof.

The low visibility, field-diverse, and fixed-tune radio antenna of the present invention transmits its signals using dual polarization to obtain field diversity. A generally small (on the order of a few inches), thin and flat shape, and rectangular printed circuit board is wrapped with conducting foil or the like with plated-through holes providing conduction between the two large flat sides of the rectangle. The antenna is wound about the substrate for a preferred resonant frequency. Alternatively, foil can be laid in between offset plated-through holes in order to obtain the helix configuration. The plated-through holes provide easy means by which such an antenna can be fabricated as upon application of the antenna foil, the margin of the substrate external to the plated-through holes can be removed by sawing, routing, or stamping.

The flat helix configuration may be square or rectangular in shape and delivers a field-diverse transmission signature that diminishes Raleigh fading, signal fading, and dead spots. The dimensions of the resulting field-diverse antenna are important, as they establish the base resonant frequency about which the antenna will naturally resonate. A radome enclosure is used to encapsulate and cover the antenna and may serve to camouflage or disguise the antenna so that it attracts less attention and will be less subject to vandalism or mischief. The radome may be cylindrical or rectangular in nature according to the dimensions of the enclosed antenna. Industry standard mounts can be used in conjunction with the constant impedance section to eliminate the need for impedance matching or allow convenient attachment of alternative or additional impedance matching networks. In the embodiment described herein, elevation of the antenna somewhat above the ground plane lowers the radiation angle.

Tuning of the antenna may be achieved by the addition of small inductors at strategic places in the antenna circuit. Also, the operating frequency of the antenna can be changed by the thickness of the covering plastic radome. This is particularly true if the radome is constructed of a dense plastic such as acetyl (often marketed under the brand name of Delrin®) or ABS having a dielectric constant of about 4. Specific embodiments of the antenna of the present invention are described in further detail below.

In one embodiment of the present invention, a low-visibility, fixed-tune, wideband, and field-diverse antenna for providing communications has an antenna-supporting core having a width and a length, and an antenna that is continuous conductively wrapped upon the core in a manner for a selected resonant frequency. The antenna radiates in a diverse manner with the horizontal and vertical field components of a field radiated by the antenna being substantially in phase and not circularly polarized. In this way, a low-visibility, field-diverse antenna is realized having helical antenna characteristics without severe circular polarization radiation. This promotes a modern, futuristic, and disguised look for reliable communications.

In another embodiment of the present invention, a low-visibility, wideband, and field-diverse antenna that is fixed-tune has a first transmission line coupled to an input. A second transmission line is coupled to the first transmission line with a shunt capacitor system coupled to the first and second transmission lines. A third transmission line is coupled to the second transmission line such that the low-visibility, wideband, and field-diverse antenna is fixed-tune, enables reliable transmission and reception characteristics in a repeatably manufacturable manner. These characteristics of the resulting antenna generally arise from the resonance traits of one or more of the three transmission lines.

DESCRIPTION OF THE PREFERRED EMBODIMENT(S)

Figure 1:
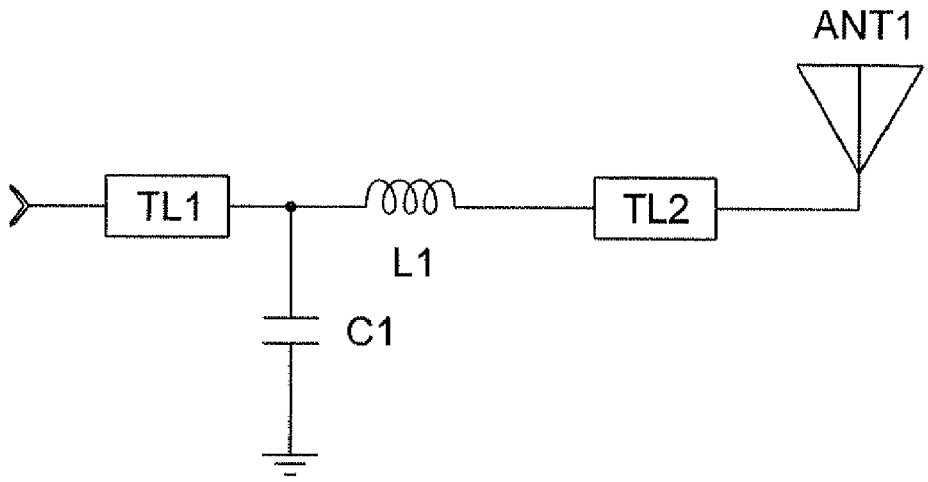
FIG. 1 (PRIOR ART)
FIG. 1 is a schematic circuit representation of the antenna set forth in U.S. Pat. No. 5,977,931.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings where like numerals of reference designate like elements throughout it will be noted that the present invention provides means by which small, low-power antennas can achieve better signal transmission and power efficiencies while avoiding intentional, mischievous destruction.

Figure 2:
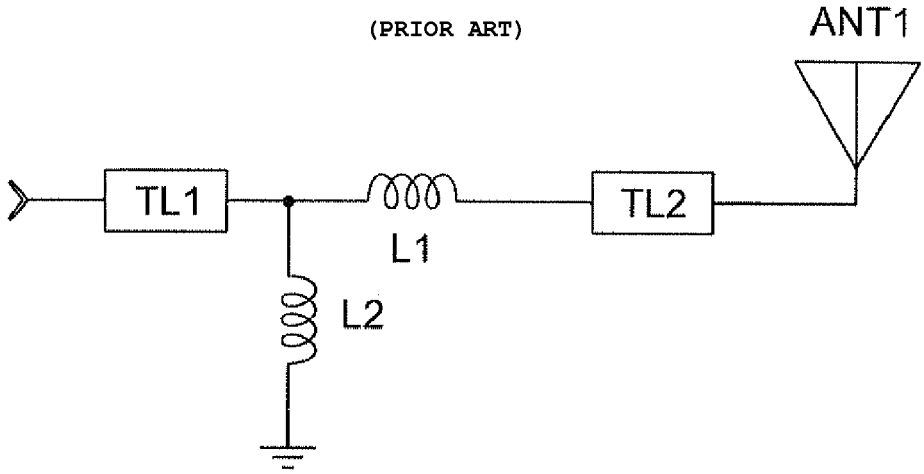
FIG. 2 (PRIOR ART)
FIG. 2 is a circuit schematic view of the antenna shown in U.S. Pat. No. 6,292,156.

FIGS. 1 and 2 show schematically single band antennas corresponding to the Openlander '931 and '156 patents, above.

Figure 3:
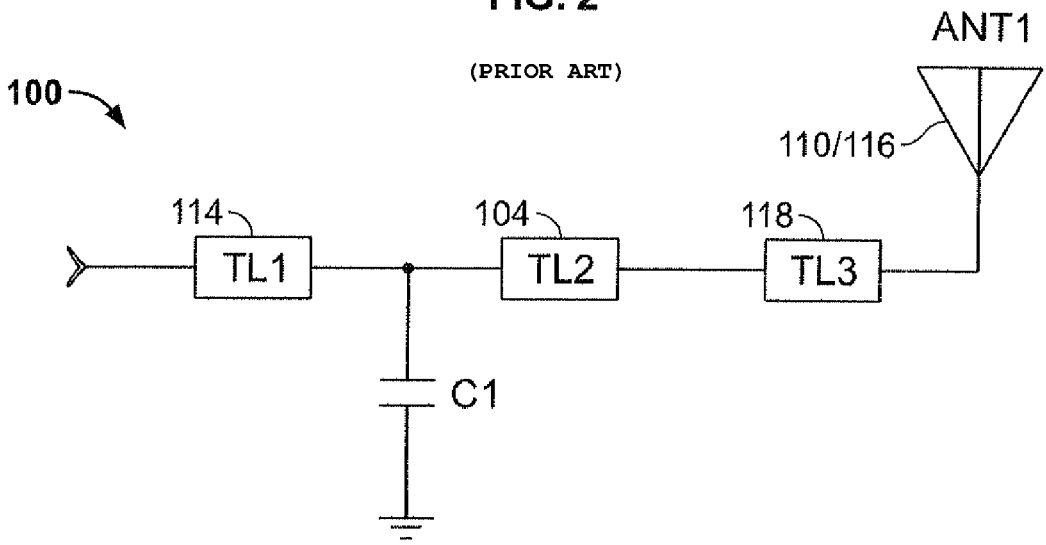
FIG. 3 is a circuit schematic of the antenna disclosed herein.

FIG. 3 is a schematic view of the low-visibility, fixed-tune, wideband, and field-diverse antenna 100 resonant circuit model of the present invention using a single shunt capacitor C1 of 5.0 pF at 1 kV in the preferred form of a ceramic capacitor for matching a selected frequency band of approximately 450-470 MHz (the lower 450-470 MHz regime) and one (1) shunt capacitor ranging from 1.0 pF to 1.5 pF at 1.0 kV ceramic capacitor for 806-866, 821/824-896, 890-960 MHz (the higher 906-960 MHz regime) to generally achieve a single selected frequency range.

The present invention does not require tuning as opposed to the previous U.S. Pat. Nos. 5,977,931 and 6,292,156, providing significant advantages for manufacture and use. This new antenna eliminates one inductor component, reducing manufacturing costs while maintaining and/or enhancing performance. In addition, TL3 improves the frequency bandwidth from 16 MHz to 20 MHz in the 450-470 MHz frequency band. The first, second, and third antenna transmission lines TL1, TL2, and TL3, respectively, are copper traces on PCB substrate represent inductance value, and radiators. Antenna ANT1 represents the radiator of the antenna 100.

In FIG. 3, TL3 is a micro-strip line with a selected thickness. TL2 is a micro-strip line with a selected length for resonant frequency. TL1, TL2, and TL3 are copper traces (micro-strip) with an approximate RF inductance at approximately 19-26 nH for all selected frequencies. The capacitance of the capacitor C1 changes to accommodate the selected resonant frequency.

This new fixed-tune antenna set forth herein reduces the components necessary (as opposed to the prior art antennas of FIGS. 1 and 2) by one inductor component which is replaced by TL2 as copper trace with selected resonant frequency length. TL1, TL2, and TL3 represent microstrip lines on the PC board which yield a very low inductance value between 19 nH to 26 nH for the frequency ranges 806-866, 824-896, 890-960 MHz. The formula for calculating inductance utilizing parallel RLC resonance circuit is as follows:

$$L=1/[((2\pi*Fo)\hat{}2)*C], \text{ where:}$$

L=inductance (approximately 19-26 nH) and Fo=resonant frequency

As a result of the new antenna design set forth herein, the resulting antennas radiation pattern is approximately 3 dB more uniform than its predecessor antennas at higher frequency within the same selected resonant frequency band.

Figure 4:
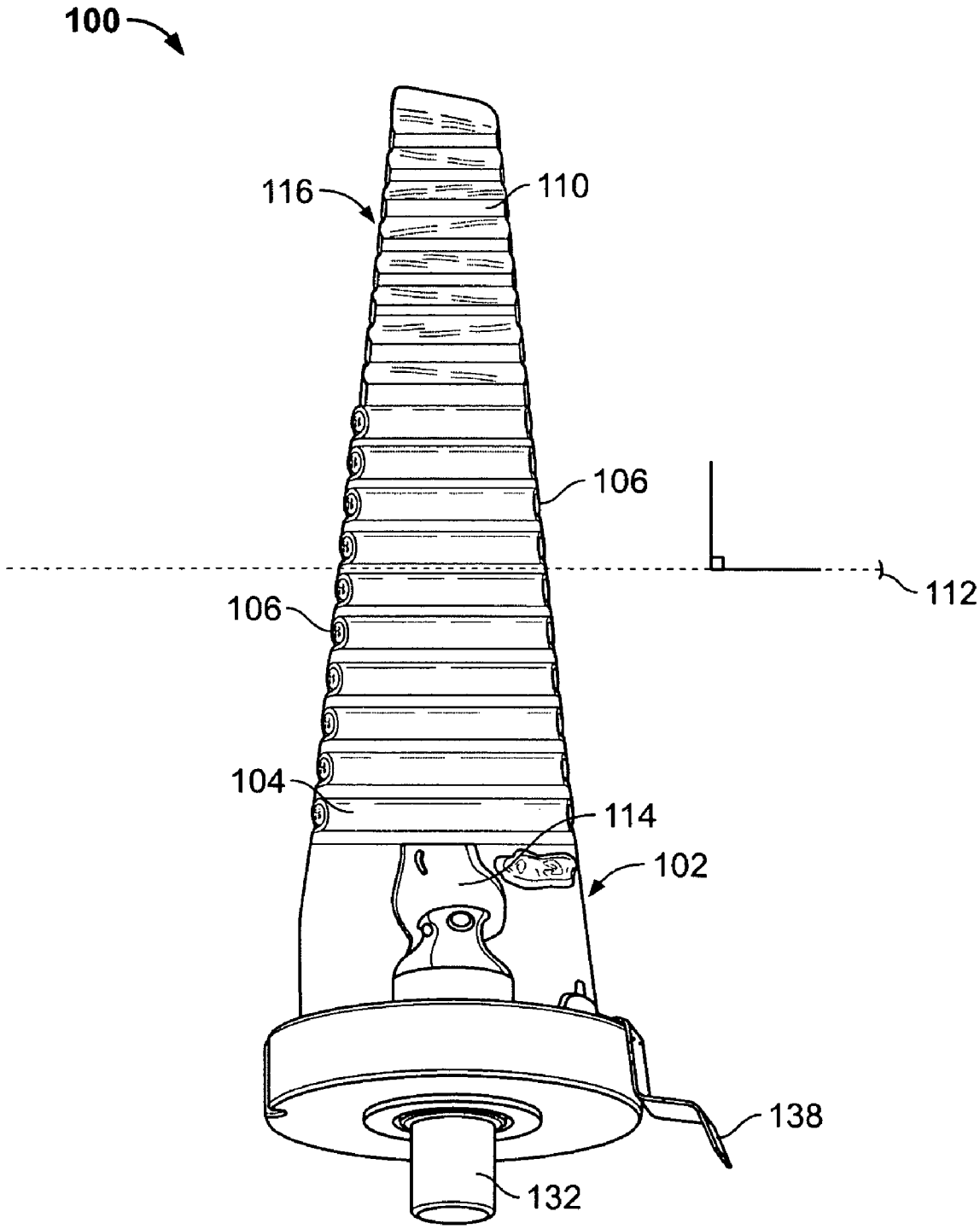
FIG. 4 is a front elevational view of the antenna set forth herein.

FIG. 4 shows a first side of the radiator of the present antenna.

Figure 5:
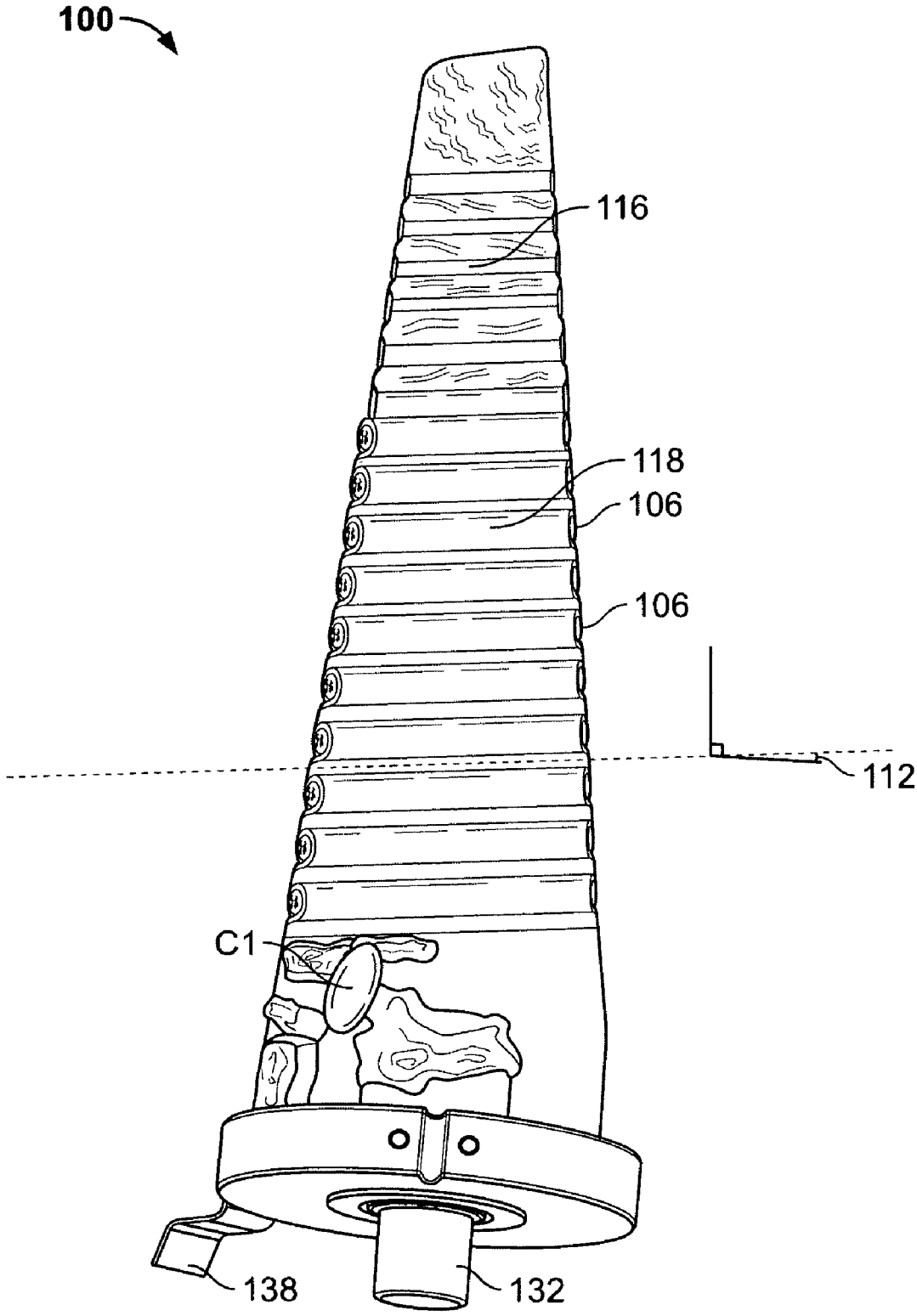
FIG. 5 is a side elevational view of the antenna as shown in FIG. 4 on the reverse side thereof.

FIG. 5 shows the reverse side of the radiator of the present antenna.

Figure 6:
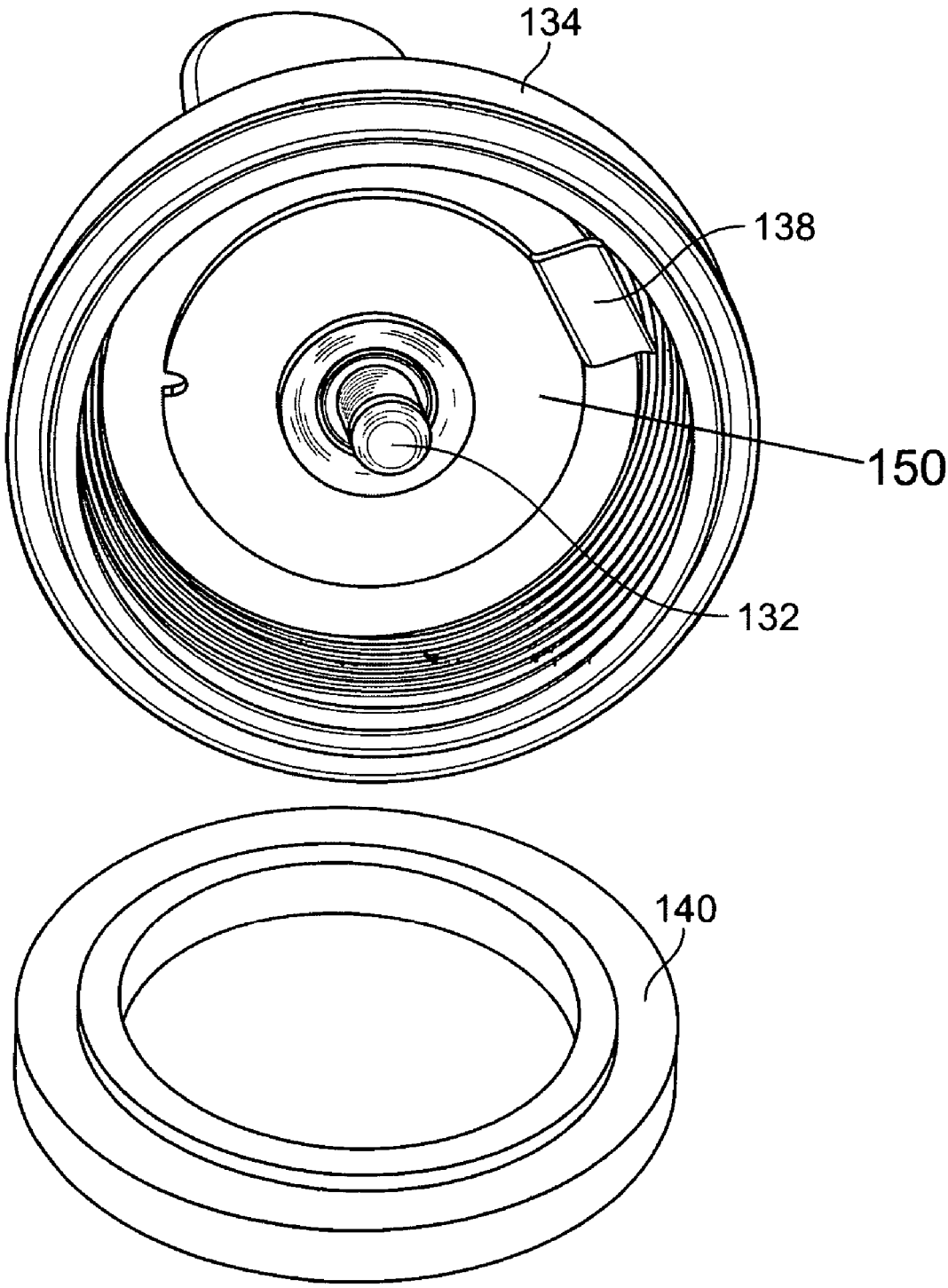
FIG. 6 is a bottom view of the antenna shown in FIGS. 4 and 5 as well as a top perspective view of the center insulator used in attaching the bottom of the antenna to an antenna mount.

FIG. 6 shows a bottom view of the industry mount, usable in conjunction with the antenna of FIGS. 4 and 5 as well as the o-ring center insulator for waterproof installation, and the sealing gasket for intermittent reduction of the present invention during construction process.

Figure 8:
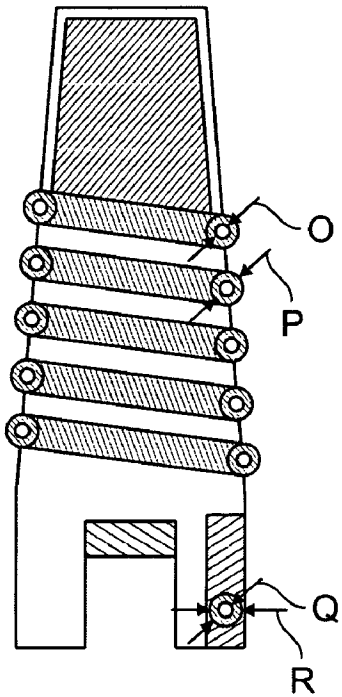
FIGS. 7 and 8 are side elevational views of one embodiment of the present invention with indicia for indicating important specifications thereof.
Figure 10:
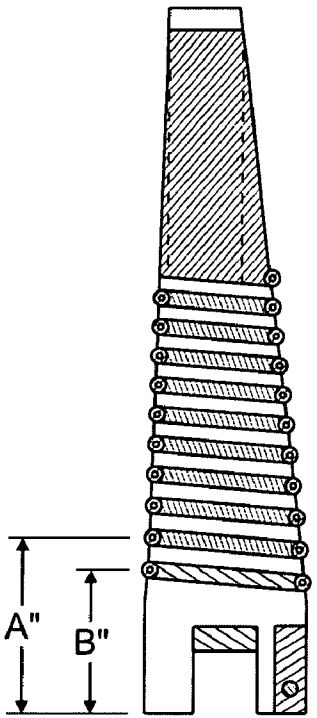
FIGS. 9 and 10 are side elevational views of another embodiment of the present antenna with indicia for indicating important or significant specifications thereof.
Figure 9:
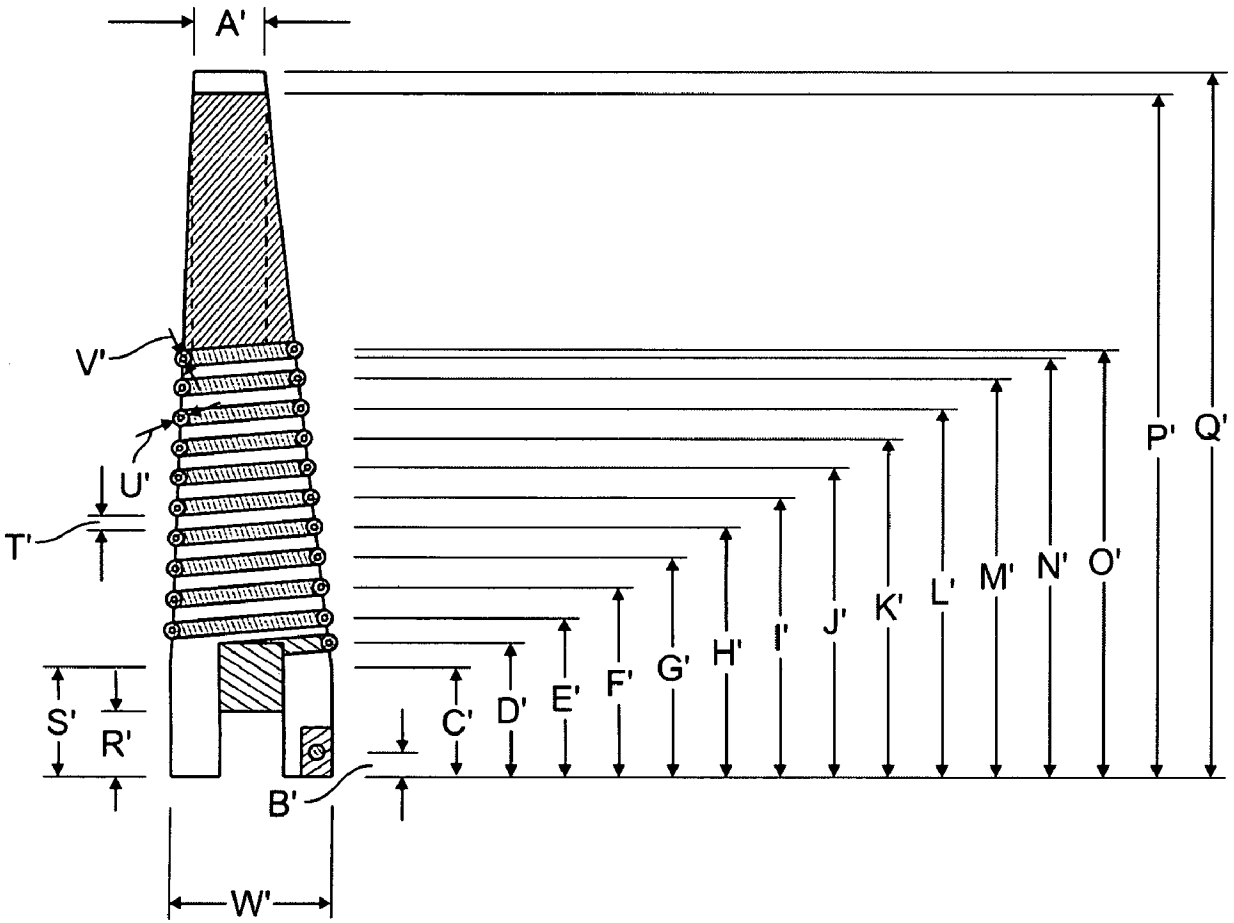

FIGS. 7-10 show the two sides of the low-visibility, fixed-tune, wideband, and field-diverse antenna of the current invention with specified distance markers for the higher 806-960 MHz regime (FIGS. 7 and 8) and the lower 450-470 MHz regime (FIGS. 9 and 10).

The low visibility, fixed-tune, wideband, and field-diverse antenna with dual polarization 100 of the present invention uses a series of three transmission lines in conjunction with a grounding capacitor as well as strictly specified manufacturing constraints in order to achieve its operating characteristics.

As shown in FIGS. 3-10, the antenna 100 of the present invention embodies a variety of unique characteristics that enable it to provide better transmission and reception characteristics.

Using a PCB substrate 102, the antenna 100 has wound around it a number of conducting strips terminating in a wide metal trace. Meandering or helical conductors act as inherent transmission lines with generally-known operating characteristics that when manufactured to the specification set forth herein, provide the operating characteristics desired.

As shown in FIGS. 4 and 5, the low visibility, fixed-tune, wideband, and field-diverse antenna 100 of the present invention has a rigid supporting PCB or other appropriate substrate 102 upon which conductors 104, 110, 114, and 116 (such as conductive metal) are applied, attached, fixed, or wound to an electrical length for a selected frequency. In this way, a relatively long length of conductor (acting as the transmitting antenna) can be held or enclosed in a housing 142-146 (FIGS. 11-13) in a generally small, thin and flat shape. As the length of the transmitting antenna generally determines the resonant frequency, providing a helical, coiled, or otherwise wound conductor in a small and thin and flat shape provides for lower visibility and a diminished chance of vandalism and mischief directed against the mechanical structure 142-146 of the antenna.

While the starting conductor 114 of the antenna 100 may be wound about the perimeter of the rigid supporting PCB substrate 102, in the preferred embodiment, holes 106 may be inscribed, drilled, or otherwise installed into the supporting PCB substrate 102. After the holes 106 have been created in the substrate 102, the interiors of the holes 106 may be plated or otherwise made conducting so that when a conductor 104 comes into contact with the plating, conduction can be achieved from one flat side of the substrate 102 to the other side of the substrate 102 and to the conductor 118 and back to conductor 104. A continuous conducting metal winding may start from conductor 114 then progress back and forth between conductors 104 and 118 which proceed in a meandering form to a uniform and wide traces 110 (FIG. 4) and 116 (FIG. 5) which are supported by the PCB substrate 102 to increase to the desirable frequency bandwidth.

In order to obtain a helical configuration the conductors 104, 118 as they travel along the exterior of the PCB substrate 102, the holes 106 are each approximately fifty-thousandths inch (0.050") in diameter and are offset according to an angle of pitch 112 (FIG. 5) that the helix formed by the conductors 104, 118 obtain when they are affixed to the substrate. This angle of pitch 112 is important as it may control or affect the measure of induction that the resulting helix obtains as an inductor. The pitch angle 112 may be different on the two sides of the antenna 100. The permittivity and/or permeability of the PCB substrate 102 may also be a factor of the magnitude of the inductive effect created by the helical conductor 104, 118 and may be accommodated by the offset of the holes 106 at the selectable pitch 112. Base conductor 114 may also be a factor in the inductance of the antenna 100. In one embodiment, the pitch 112 is achieved by spacing the holes 106 approximately fifty-thousandths inch (0.050") apart and providing a space of approximately fifty-thousandths inch (0.050") between the copper traces 104, 114, and 118.

As described in the prior U.S. patents to Openlander, U.S. Pat. Nos. 6,292,156 and 5,977,931 (both of which are incorporated herein), the holes 106 intermediating the strips of conductor 104, 118 to achieve the helical transmitter antenna, may be situated in a spaced apart relation with an outermost edge of the PCB substrate 102 to create a margin separating the edge of the PCB substrate 102 from the holes 106.

Upon completion of the conductor-affixing process where the conducting foils 104, 118 may be fixed to the opposite faces of the PCB substrate 102 and intermediated by the plated-through holes 106, the margin (not shown) can be removed from the center portion of PCB substrate 102. This removal process generally entails cutting the margin off from the center portion along the center of the holes 106. Additional margin may be cut away by expanding the margin and increasing the center portion during the cutting process so long as the conducting foil, 104, 118 is not torn, broken, made discontinuous or otherwise injured. The holes 106 may be made of sufficiently large diameter, on the order of fifty thousandths of an inch (0.050"), to make removal of the margin easier. With such diameter holes 106, the cutting, sawing, or stamping process does little damage to the connecting foil and expensive tooling is generally not needed to reduce the size of the resulting antenna 100 by removing the margin.

Having properly chosen the dimensions and properly applied the materials of the antenna 100 as shown in FIGS. 4 and 5, the predominant portion of the antenna has been created. The pitch and width of the helix, the pitch being approximately fifty-thousandths inch (0.050") and width being approximately seventy-thousandths inch (0.070"), and the length and width of the conductors 114, 104, and 118, the permittivity and permeability of the PCB substrate 102, as well as the frequencies involved all affect the operating characteristics of the antenna of the current invention and provide means by which such antennas may be tuned by altering the characteristics of these and other parameters.

As these parameters are generally fixed upon construction, likewise the tuning, or frequency regime, of the resulting antenna is also fixed. Consequently, the particular dimensions of the resulting antenna may very likely control the operation of that antenna. Such particular dimensions are explicitly set forth herein and are believed to constitute patentable subject matter as tuning of the antenna 100 occurs during the design and manufacture of it and occurs to a degree that may be greatly diminished after manufacture. This is in distinction to many, if not most, antennas which are tuned to a significant degree after construction/manufacture.

While simple in construction, the fixed-tune antenna 100 constructed along the lines of the present invention is electronically sophisticated and reflects this sophistication in its transmission characteristics of field diversity coupled with low visibility, dual polarization, and energy efficiency. By providing a low visibility field-diverse antenna transmitting in a plurality of polarities, Raleigh fading, signal fading, and dead spots are reduced by avoiding destructive interference while signal transmission is correspondingly enhanced in accordance with the power restrictions for weak or low power transmitters. By providing such an antenna, cellular and other personal communications become greatly enhanced as they are more reliable within the confines of the power restrictions involved.

Figure 11:
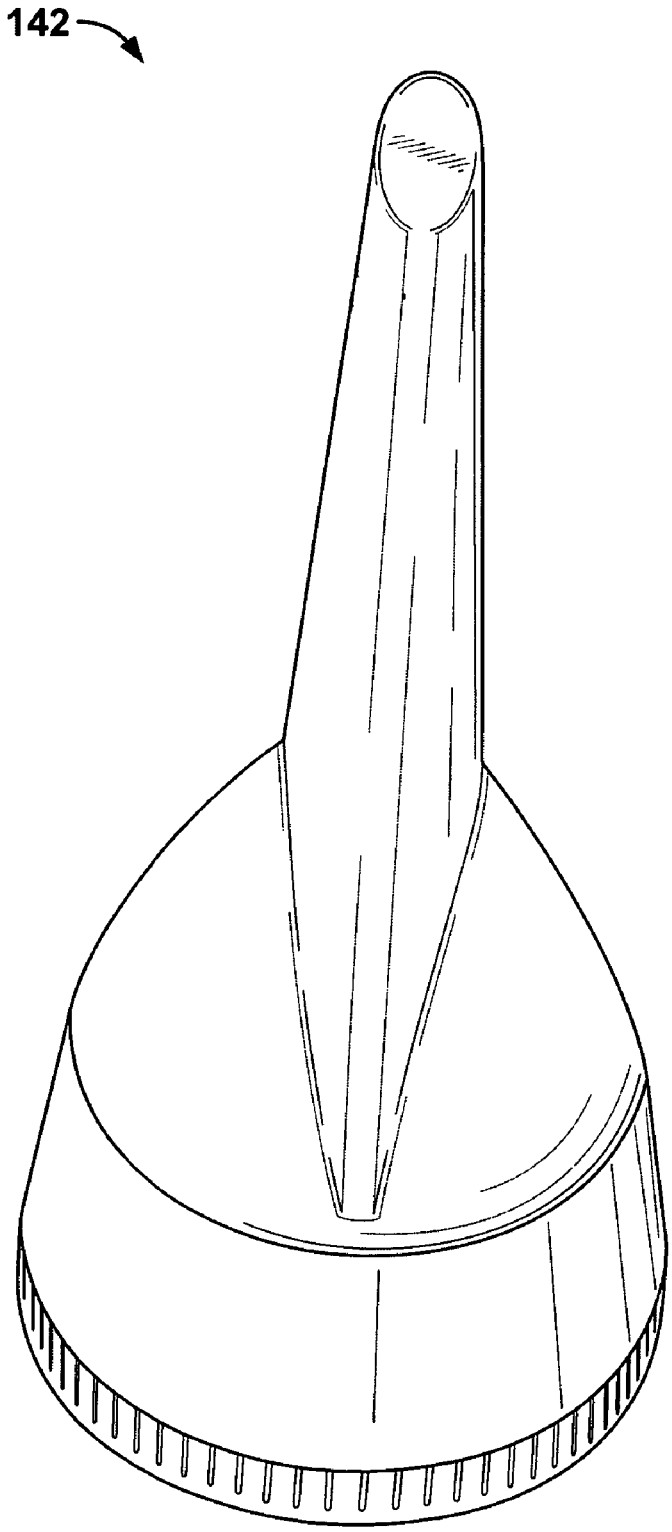
FIGS. 11-13 are perspective views of various radomes that can be used in conjunction with various embodiments of the present invention.
Figure 12:
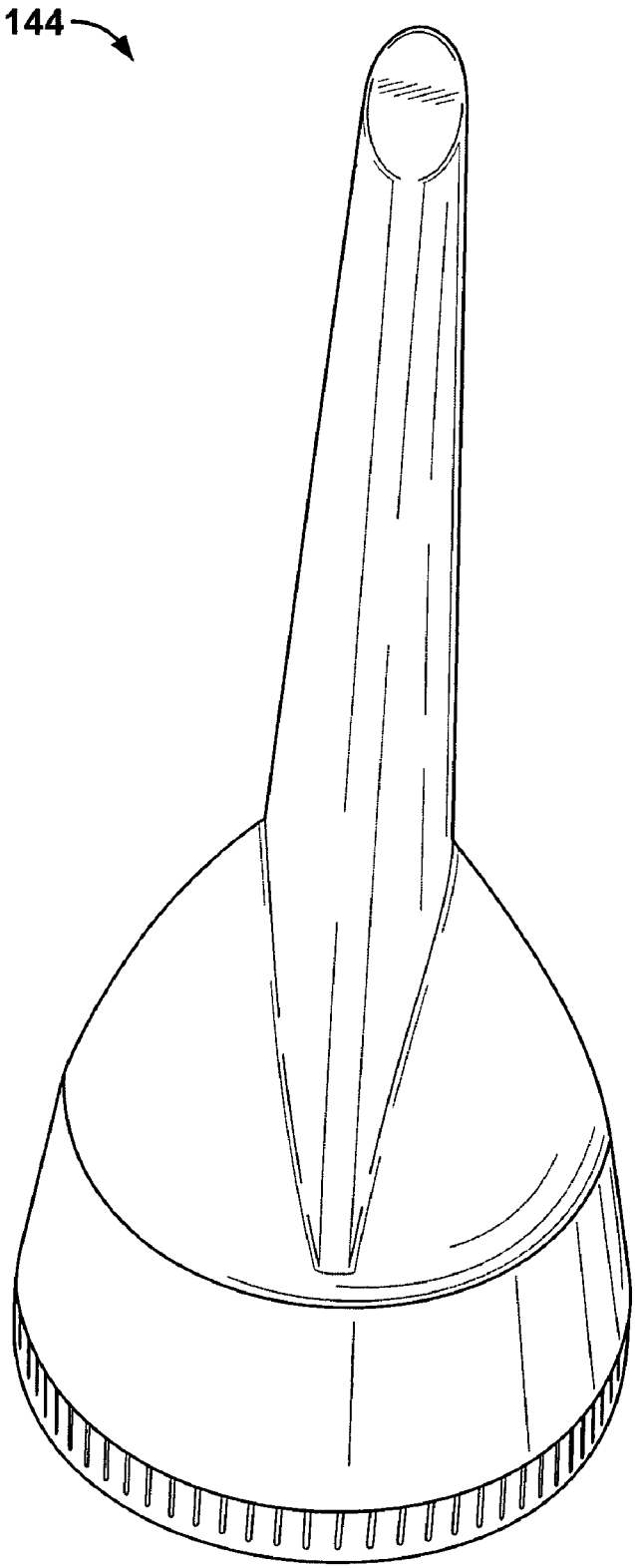
Figure 13:
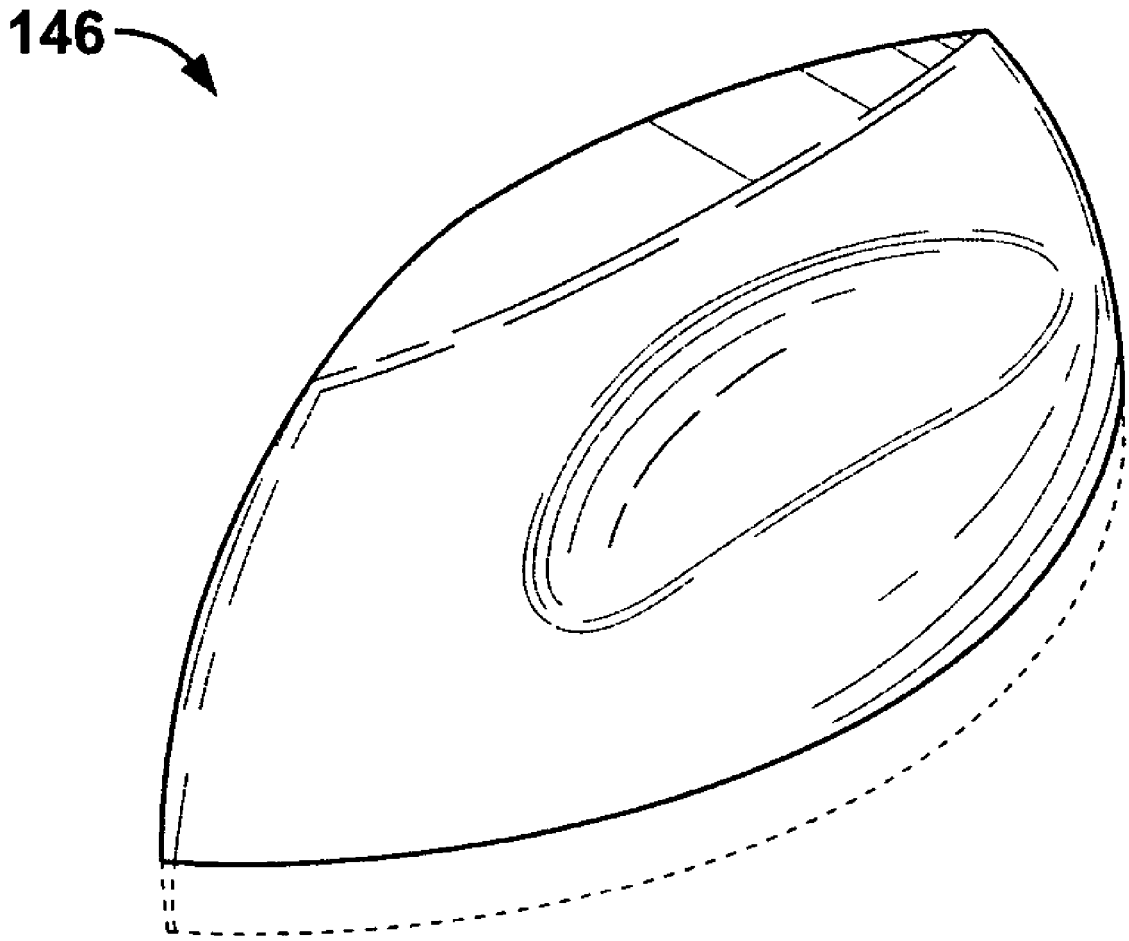

FIGS. 11-13 show alternative embodiments of a radome for the antenna. FIG. 6 shows a mounting system having a grounding rail 134 (which helps to maintain constant the impedance of the antenna circuit), a center insulator 140, a base 150, and a center connecting pin 132 for standard connection to standard antenna-receiving sockets and the like (not shown).

In FIG. 6, an antenna 100 constructed along the lines set forth above in conformance with the present invention is shown in at its mounting base and includes a grounding rail 134, a center insulator 140, a grounding leaf 138, and a center connecting pin 132.

The radomes 142-146 may be formed in a shape generally along the lines of the antenna 100. As the antenna 100 is generally thin and flat or rectangular in shape, the radomes 142-146 may likewise be rectangular or square in shape and generally thin in order to provide the lowest profile possible for the low visibility field-diverse fixed-tune antenna of the present invention. The radomes 142-146 should be constructed of weatherproof and weathertight materials such as dense plastic or ABS the like. Additionally, such plastics may change the operating characteristics of the signals transmitted by the antenna 100. Particularly, it is known that dense plastics with a dielectric constant of four (4) (such as dense acetyl plastics marketed under the brand name Delrin®) or ABS, alter the operating frequency of the antenna. Such a feature or other characteristics may generally be taken into account in the construction and design of the present invention.

The radomes 142-146 may be attached to a standard base (not shown) known in the industry for easy connection of the antenna 100 to industry standard mounts. In conjunction with the attachment of the radomes 142-146 to such a base, accompanying performance-enhancing components or elements can be added to the antenna of the present invention to increase and maximize its performance.

The grounding rail 134 may be added to provide the ground for the antenna 100. However, it is contemplated that the antenna of the present invention may be used with or without a ground plane and still perform well to deliver good signal transmission and communications. The grounding rail 134 may incorporate or provide a constant impedance circuit thereby widening the operating bandwidth of the transmitting antenna 100. As mentioned above, monopole antennas generally have a narrow bandwidth. By providing a bandwidth-broadening constant impedance section, the utility and operating bandwidth of the antenna of the present invention is enhanced through the use of terminal conductors 110 and 116 (FIGS. 4 and 5). Additionally, signal energy impressed upon the antenna 100 is more likely to be transmitted than reflected.

The use of the ground railing 134 with a constant impedance section may eliminate the need for impedance matching in some antenna configurations and may allow for the convenient attachment of impedance matching networks and other circuits. The grounding rail 134 may be toroidal in nature and manufactured of materials known in the art. A central aperture or hole present in the grounding rail 134 may provide room for a similarly circular projection from the center insulator 140.

The center insulator 140 may also be circular in nature to provide a foundation upon which the grounding rail 134 rests. An O-ring (not shown) may underlie the center insulation or sealing and provide a means by which attachment can be made between the plastic insulator radomes 142-146 and a standard industry mount or other mount. The O-ring serves to separate the radome from the grounding rail 134.

A center connecting pin 132 connecting the transmitter (not shown) to the antenna 100 may pass through the O-ring to attach to the antenna 100 via the grounding rail 134 or otherwise. The connection of the center connecting pin 132 with any intermediating network provided by the grounding rail 134 or otherwise serves to couple the transmitter to the antenna so that the enhanced operating characteristics of the antenna 100 are available to the transmitter (not shown).

FIGS. 7-10 show side elevation views of two embodiments of the present invention. Indicia are given in regards to both embodiments, indicating certain heights, measurements, and distances which are reflected below in the table below indicating the distances and indicating the associated indicia.

Figure 7:
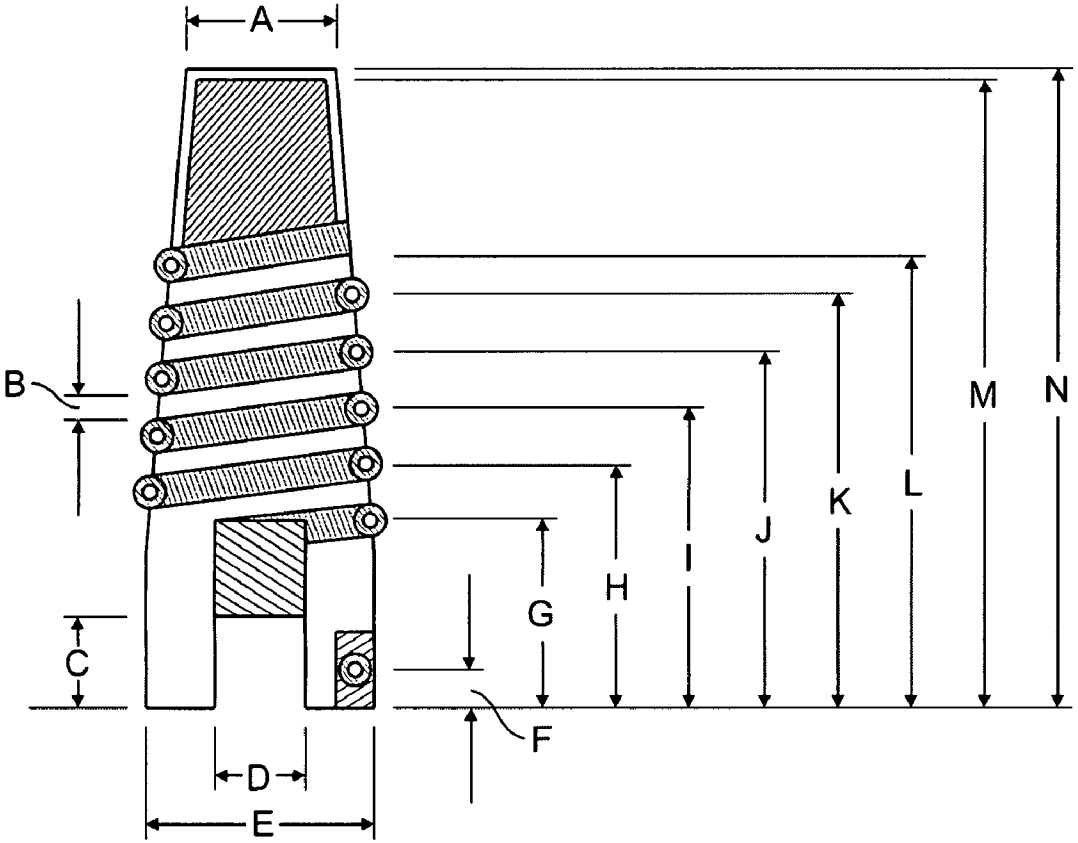

FIGS. 7 and 8 generally correspond to one embodiment that may operate across a variety of frequency regimes including the following frequency bands: 806-866 MHz, 821-896 MHz, 890-960 MHz, 902-928 MHz, 2400-2500 MHz. These frequency ranges respectively correspond to the last five columns of the table below. The embodiment shown in FIGS. 9-10 generally corresponds to a frequency band of 450-470 MHz with the relevant specified distances shown in column 2 of the table below. Also indicated in the table is the capacitance of the capacitor C1 which is generally attached ground through the grounding leaf 138.

Having described the construction, operation, and utility of the present invention, specific embodiments and advantageous features of the antenna of the present invention are set forth in more detail below.

In one embodiment realized in conformance with the construction of the present invention, a short UHF antenna constructed in an approximately three and one-half (3.45") high radome. This antenna, when tuned for a center frequency of 460 MHz, had a 20 MHz bandwidth with a VSWR of 2.0:1. In a second realized embodiment of the present invention, a short and wide bandwidth antenna for the 806-866 MHz frequency range was achieved. This second antenna used the geometry set forth herein and was realized in a two and three-quarter inch (2¾") tall radome antenna having a 60 MHz bandwidth as required for the duplexed radio bands at 806-866 MHz, 824-896 MHz, and 890-960 MHz. The present invention improves upon the tuning required for the antennas set forth in U.S. Pat. Nos. 5,977,931 and 6,292,156 by providing a fixed-tune antenna.

For the frequency bands 806-866 MHz and 821-896 MHz, a single shunt capacitor C1 may be used with a rating of 1.5 pF at 1.0 kV. For the frequency band of 890-960 MHz a single shunt capacitor C1 may be used with a rating of 1.0 pF at 1.0 kV. For these capacitors, the voltage ratings may depend on the power handling requirement of the antenna 100.

While ground planes are common for the current mobile antennas and small antennas (which the antenna of the present invention may replace), such ground planes are not required for good utility and operation of the present invention. For the 902-928 MHz ISM band, the present antenna delivers good performance and signal transmission without a ground plane. This band is one which is increasingly used for spread spectrum, data modem, cellular and PCS communications. Even without a ground plane, the antenna of the present invention has the property of keeping the same VSWR curve with respect to its ground plane and has near equal signal radiation in both the horizontal and vertical planes. This field diversity has been shown to usefully reject reflected interference signals.

The present invention may also be used for sub-miniature antennas for hand-held portable applications. Such antennas can be scaled in size for mounting on hand-held radios, data modems, and the like. Such radios may be used in factories and warehouses to transmit encoded package information for inventory and shipping control. The present antenna, when mounted on the edge of a ground plane and tune for the spread spectrum data band, exhibits similar field diversity to the ISM band antenna described immediately above.

When used without a ground plane, the horizontal signal strength of an antenna constructed along the lines of the present invention may be between 10 and 12 dB below the vertical signal strength over the band. The phases are equal. With a quarter wave antenna, the horizontal signal is typically 17 to 20 dB below the vertical signal strength (−17 to −20 dB), showing the enhanced utility, performance, and operation of the antenna of the present invention.

The following table will be of use to those of ordinary skill in the art in constructing antennas according to the present invention. The trademarks PHANTOM® and PHANTOM ELITE™ are owned by Antenex, Inc. of Glendale Heights, Ill. The indices in parenthesis refer to the drawings and disclosure herein. Please note that columns 2-6 generally correspond to the embodiment shown in FIGS. 7 and 8, while column 7 generally corresponds to the embodiment shown in FIGS. 9 and 10.

Of note is the fact that the bigger antenna of FIGS. 9 and 10 corresponds to a lower frequency. Consequently, as smaller antennas help to deliver transmissions at higher frequencies, consistent manufacturing may be important to ensure predictable, reliable, and consistent antenna results.

| | (FIGS. 7 and 8) | | | | | (FIGS. |
|---|---|---|---|---|---|---|
| | Phantom Elite ™ Model # | | | | | 9 and 10) |
| | ETRA8063 | ETRA8213 | ETRA8903 | ETRA9023 | ETRA24003 | ETRA4503 |
| Frequency of interest | 806-866 MHz | 821-896 MHz | 890-960 MHz | 902-928 MHz | 2400-2500 MHz | 450-470 MHz |
| Gain, dBi | 3 dB-MEG, Field diversity | 3 dB-MEG, Field diversity | 3 dB-MEG, Field diversity | 3 dB-MEG, Field diversity | 3 dB-MEG, Field diversity | 3 dB-MEG, Field diversity |
| Spacing between copper trace, TL2 (B, T') | 0.050 | 0.050 | 0.050 | 0.050 | 0.050 | 0.050 |
| Board thickness (102) | 0.062" | 0.062" | 0.062" | 0.062" | 0.062" | 0.062" |
| Trace thickness (104, 118) | 0.100" | 0.100" | 0.100" | 0.100" | 0.100" | 0.070" |
| Vias/Hole Size drill (O, V') | 0.050" | 0.050" | 0.050" | 0.050" | 0.050" | 0.050" |
| Board Width Bottom (E, W') | 0.620" | 0.620" | 0.620" | 0.620" | 0.620" | 0.650" |
| Board Top Width (A, A') | 0.400" | 0.400" | 0.400" | 0.400" | 0.400" | 0.286" |
| PC Board (102) Height (N, Q') | 1.700" | 1.700" | 1.700" | 1.700" | 1.700" | 2.790" |
| Height of Hole #1 (F, B') | 0.100" | 0.100" | 0.100" | 0.100" | 0.100" | 0.100" |
| Height of Hole #2 (G, D') | 0.500" | 0.500" | 0.500" | 0.500" | 0.500" | 0.500" |
| Height of Hole #3 (H, E') | 0.650" | 0.650" | 0.650" | 0.650" | 0.650" | 0.620" |
| Height of Hole #4 (I, F') | 0.800" | 0.800" | 0.800" | 0.800" | 0.800" | 0.740" |
| Height of Hole #5 (J, G') | 0.950" | 0.950" | 0.950" | 0.950" | 0.950" | 0.860" |
| Height of Hole #6 (K, H') | 1.100" | 1.100" | 1.100" | 1.100" | 1.100" | 0.980" |
| Height of Hole #7 (I') | NA | NA | NA | NA | NA | 1.100" |
| Height of Hole #8 (J') | NA | NA | NA | NA | NA | 1.220" |
| Height of Hole #9 (K') | NA | NA | NA | NA | NA | 1.340" |
| Height of Hole #10 (L') | NA | NA | NA | NA | NA | 1.460" |
| Height of Hole #11 (M') | NA | NA | NA | NA | NA | 1.580" |
| Height of Hole #12 (O') | NA | NA | NA | NA | NA | 1.700" |
| Height of Antenna to Radiator (110) Bottom | 1.200" | 1.200" | 1.200" | 1.200" | 1.200" | 1.666" |
| Height of Substrate (102) | 1.700" | 1.700" | 1.700" | 1.700" | 1.700" | 2.790" |

-continued

| | (FIGS. 7 and 8) | | | | | (FIGS. 9 and 10) |
|---|---|---|---|---|---|---|
| | Phantom Elite ™ Model # | | | | | |
| | ETRA8063 | ETRA8213 | ETRA8903 | ETRA9023 | ETRA24003 | ETRA4503 |
| Radiator Dimension from substrate (102) bottom to the top of TL3 conductor (110) | 1.680" | 1.570" | 1.410" | 1.400" | 1.680" | 2.710" |
| Capacitor, C1 | 1.5 pF, 1 kV ceramic capacitor | 1.5 pF, 1 kV ceramic capacitor | 1.0 pF, 1 kV ceramic capacitor | 1.0 pF, 1 kV ceramic capacitor | 1.0 pF, 1 kV two (2) ceramic capacitors wrapped in series at a selected location to get resonance at 2450 MHz | 5.0 pF, 1 kV ceramic capacitor |
| PC Board Material | FR4 | FR4 | FR4 | FR4 | FR4 | FR4 |

In an additional embodiment of the present invention, antennas constructed according to the present invention may be stacked to provide an end-fed collinear antenna array. Such an array may be driven using a phase shift network to increase the utility and benefits of the antenna of the present invention.

The response curve characteristics of antennas constructed according to the present invention include flat response curves and easily realizable manufacturing techniques. Prior to the invention of the present antenna, the performance characteristics in the band regimes addressed by the present antenna had not previously been sought or achieved. The cross-polarization, or polarization diversity, achieved by the present invention provides very reliable communications diminishing the interference patterns creating Raleigh/signal fading and dead spots. In fact, radio transmitters using antennas constructed along the lines of the present invention have been used to good advantage by stock cars racing under the auspices of the National Association for Stock Car Auto Racing (NASCAR). However, due to aerodynamic requirements, these antennas are no longer currently in use, but performed well. Additionally, other stock car racing circuits allow the use of the antenna and have found it to also perform successfully.

By way of example, and not of limitation, several goals (or objectives), of the present antenna are set forth below. These proclaimed ends sought to be achieved by the antenna set forth herein are only some of many such ends that might be achieved the antenna.

The present antenna seeks to provide a low visibility antenna that avoids Raleigh fading during transmission and to provide a low visibility antenna that radiates in a field-diverse manner. Further, the present antenna seeks to provide a low visibility antenna that is fixed-tune field-diverse antenna and to provide wide frequency bandwidth that matching impedance can be obtained when edging the radiator thick and wide uniformly at a strategic location. Further goals include providing an antenna that promotes a modern, futuristic, and disguised look for reliable communications as well as providing a method of manufacturing the present antenna. The present antenna also seeks to provide a low visibility field-diverse antenna that matches industry standard connections, can receive an impedance matching network, and that can maximize radiative efficiencies. These and other goals, characteristics, and advantages of the present antenna will be apparent from a review of the specification set forth herein as well as the accompanying drawings.

While the present antenna has been described with regards to particular embodiments, it is recognized that additional variations of the present antenna may be devised without departing from the inventive concept.

What is claimed is:

1. A low-visibility, wideband, and field-diverse antenna that is fixed-tune comprising:

a first transmission line coupled to an input;

a second transmission line coupled to said first transmission line;

a shunt capacitor coupled to said first and second transmission lines, said shunt capacitor comprising a 5.0 pF at 1 kV ceramic capacitor for selectably matching a frequency range of approximately 450-470 MHz; and a third transmission line coupled to said second transmission line.

2. A low-visibility, wideband, and field-diverse antenna that is fixed-tune comprising:

a first transmission line coupled to an input;

a second transmission line coupled to said first transmission line;

a shunt capacitor coupled to said first and second transmission lines, said shunt capacitor comprising a 1.5 pF at 1.0 kV shunt ceramic capacitor for selectably matching frequency ranges of approximately 806-866, 821-896, and 824-896 MHz; and a third transmission line coupled to said second transmission line.

3. A low-visibility, wideband, and field-diverse antenna that is fixed-tune comprising:

a first transmission line coupled to an input;

a second transmission line coupled to said first transmission line;

a shunt capacitor coupled to said first and second transmission lines, said shunt capacitor comprising a 1.0 pF at 1.0 kV shunt ceramic capacitor for selectably matching a frequency range of approximately 890-960 MHz or a frequency range of approximately 902-928 MHz; and a third transmission line coupled to said second transmission line.

4. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

said first, second and third transmission lines provide an inductance in the range of 19-26 nH;

said second transmission line is a micro-strip line having a length that is pre-selected for a resonant frequency; and said third transmission line is a micro-strip line having a thickness that is pre-selected.

5. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line; and an antenna core, said antenna core supporting said first, second, and third transmission lines.

6. A low-visibility, wideband, and field-diverse antenna that is fixed-tune as set forth in claim 5, further comprising:

said first, second, and third transmission lines being conductive traces.

7. A low-visibility, wideband, and field-diverse antenna that is fixed-tune as set forth in claim 6, wherein said conductive traces include copper.

8. A low-visibility, wideband, and field-diverse antenna that is fixed-tune as set forth in claim 5, wherein said antenna core further comprises a printed circuit board (PCB) substrate.

9. A low-visibility, wideband, and field-diverse antenna that is fixed-tune as set forth in claim 5, further comprising:

said antenna core conducts from one flat side to another via at least a portion of a plated-through hole.

10. A low-visibility, wideband, and field-diverse antenna that is fixed-tune as set forth in claim 5, wherein the shunt capacitor includes a capacitor coupled to said first and second transmission lines, and wherein the second transmission line is disposed between the first and third transmission lines without an inductor component between the first and third transmission lines.

11. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein said first, second and third transmission lines are operable for providing an inductance in the range of 19 nanoHenries (nH) to 26 nH for the frequency ranges of 806-866, 821-896, and 890-960 Megahertz.

12. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein said first, second, and third transmission lines comprise micro-strip lines on a printed circuit board.

13. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein the low-visibility, wideband, and field-diverse antenna is fixed-tune, thereby enabling reliable transmission and reception characteristics in a repeatably manufacturable manner.

14. A low-visibility, wideband, and field-diverse antenna comprising:

a first transmission line coupled to an input;

a second transmission line coupled to said first transmission line;

a shunt capacitor coupled to said first and second transmission lines;

a third transmission line coupled to said second transmission line;

an antenna-supporting core; and an antenna coupled to at least one or more of said shunt capacitor and said first, second, and third transmission lines, said antenna having a continuously conducting path continuous conductively wrapped upon said core in a manner for a selected resonant frequency, said antenna radiating in a diverse manner with horizontal and vertical field components of a field radiated by said antenna substantially in phase and not circularly polarized.

15. A low-visibility, wideband, and field-diverse antenna that is fixed-tune as set forth in claim 14, wherein the low-visibility, fixed-tune, wideband field-diverse antenna is configured having helical antenna characteristics without severe circular polarization radiation thereby promoting ease of repeated antenna manufacture for reliable communications.

16. A low-visibility, wideband, and field-diverse antenna that is fixed-tune as set forth in claim 14, further comprising a radome covering said core and said antenna and operable for changing the operating frequency of the antenna.

17. A low-visibility, wideband, and field-diverse antenna that is fixed-tune as set forth in claim 16, wherein said radome comprises a material having a dielectric constant of approximately 4.

18. A low-visibility, wideband, and field-diverse antenna that is fixed-tune as set forth in claim 16, wherein:

said antenna core has a flat shape and fits within said radome; and said radome is thin with a height of approximately three inches tall, whereby said radome helps and promotes disguise of said radome as said radome is smaller and less intruding while said antenna covered by said radome provides good operation.

19. A low-visibility, wideband, and field-diverse antenna that is fixed-tune as set forth in claim 16, wherein:

said radome is approximately three and one-half inches tall; and said shunt capacitor comprises a shunt ceramic capacitor of approximately 5.0 pF at approximately 1 kV at a selected length for a center frequency of approximately 460 MHz with a bandwidth of approximately 20 MHz with a VSWR of approximately 2.0:1.

20. A low-visibility, wideband, and field-diverse antenna that is fixed-tune as set forth in claim 16, wherein:

said radome is approximately two and three-quarter inches (2 ¾") tall;

said shunt capacitor comprises a shunt ceramic capacitor of approximately 1.5 pF at approximately 1 kV; and said antenna having a bandwidth of approximately 60 MHz for at least one of the duplexed radio bands at approximately 806-869 MHz, approximately 824-896 MHz, and approximately 890-960 MHz.

21. A low-visibility, wideband, and field-diverse antenna that is fixed-tune as set forth in claim 14, wherein the antenna includes a meandering conductive printed circuit trace and a wide conducting radiator at a top of said antenna core coupled to the meandering conductive printed circuit trace for a specific frequency, whereby the antenna is operable for providing a wide frequency bandwidth.

22. A low-visibility, wideband, and field-diverse antenna that is fixed-tune as set forth in claim 14, wherein:

said antenna core comprises a non-metallic material substrate that is generally flat and thin having a thickness of approximately 0.062" thick; and said antenna comprises continuous conductive wrapping meandering upon said antenna core to provide an antenna for a specific resonant frequency.

23. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein said antenna does not include any resistors or inductors disposed between said shunt capacitor and said first, second, and third transmission lines.

24. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein said antenna include only a single one of said shunt capacitor.

25. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein said antenna is configured to transmit signals using dual polarization to obtain field diversity.

26. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein said shunt capacitor is a ceramic capacitor of 5.0 pF at 1 kV for matching a selected frequency band of about 450-470 MHz, or said shunt capacitor is a ceramic capacitor ranging from 1.0 pF to 1.5 pF at 1.0 kV for matching a selected frequency band of about 806-960 MHz.

27. A low-visibility, wideband, and field-diverse antenna that is fixed-tune, comprising:

a first transmission line coupled to an input;

a second transmission line coupled to said first transmission line;

a shunt capacitor coupled to said first and second transmission lines;

a third transmission line coupled to said second transmission line;

wherein said shunt capacitor is capable of changing capacitance to accommodate selected resonance frequencies coupled to said first and second transmission lines.

* * * * *

UNITED STATES PATENT AND TRADEMARK OFFICE

CERTIFICATE OF CORRECTION

PATENT NO. : 7,639,204 B2
APPLICATION NO. : 11/434101
DATED : December 29, 2009
INVENTOR(S) : Tam Hung Chau It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 762 days.

Signed and Sealed this

Ninth Day of November, 2010

David J. Kappos

David J. Kappos
*Director of the United States Patent and Trademark Office*